US010131152B2

(12) United States Patent
Shirono

(10) Patent No.: US 10,131,152 B2
(45) Date of Patent: Nov. 20, 2018

(54) INKJET PRINTER

(71) Applicant: BROTHER KOGYO KABUSHIKI KAISHA, Nagoya-shi, Aichi-ken (JP)

(72) Inventor: Taichi Shirono, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/718,966

(22) Filed: Sep. 28, 2017

(65) Prior Publication Data

US 2018/0093489 A1 Apr. 5, 2018

(30) Foreign Application Priority Data

Sep. 30, 2016 (CN) ..... 2016 2 1102040 U
Apr. 28, 2017 (CN) ..... 2017 2 0470457 U

(51) Int. Cl.
*B41J 2/175* (2006.01)
*B41J 29/13* (2006.01)
*B41J 29/02* (2006.01)

(52) U.S. Cl.
CPC ..... *B41J 2/17553* (2013.01); *B41J 2/175* (2013.01); *B41J 2/1754* (2013.01); *B41J 29/02* (2013.01); *B41J 29/13* (2013.01)

(58) Field of Classification Search
USPC ..... 347/19, 85, 86
See application file for complete search history.

(56) References Cited

U.S. PATENT DOCUMENTS 6,547,363 B1 * 4/2003 Shinada ..... B41J 2/17503 347/19
9,139,013 B2 * 9/2015 Nagashima ..... B41J 2/17513
2015/0360476 A1 12/2015 Osakabe et al.
2016/0009098 A1 * 1/2016 Kimura ..... B41J 2/17566 347/86
2016/0089893 A1 3/2016 Osakabe et al.

FOREIGN PATENT DOCUMENTS

JP 2016-504 A 1/2016
JP 2016-68473 A 5/2016

* cited by examiner

*Primary Examiner* — Lam Nguyen
(74) *Attorney, Agent, or Firm* — Merchant & Gould P.C.

(57) ABSTRACT

An inkjet printer includes a printer body, an ink container and a cover member. The cover member is pivotable about a pivot shaft. The ink container includes an ink containing portion, a sealing member, a frame portion and a cover portion. A top portion of the ink containing portion includes a port. The cover portion is pivotable about a first pivot axis between a maximum opened position and a closed position. One of a first opposing surface of the cover member and a second opposing surface of the cover portion is provided with a protrusion, and the other is provided with a recess portion. When the cover portion is in the closed position and the cover member is in the second position, a distance between the protrusion and the pivot shaft is equal to a distance between the recess portion and the pivot shaft.

15 Claims, 9 Drawing Sheets

INKJET PRINTER

CROSS-REFERENCE TO RELATED APPLICATION

This application claims priority from Chinese Utility Model Applications No. 201621102040.8, filed on Sep. 30, 2016, and No. 201720470457.8, filed on Apr. 28, 2017, which are incorporated herein by reference in their entirety.

TECHNICAL FIELD

The disclosure relates to an inkjet printer.

BACKGROUND

Known inkjet printers, as depicted in FIGS. 1 to 3, typically include a printer body 10 and a cover member 30 including a flatbed scanner, for example, therein. The cover member 30 is pivotally connected to the printer body 10 by a pivot shaft AX1 and pivotable between a first position (FIG. 2), in which an upper surface of the printer body 12 is exposed, and a second position (FIG. 1), in which the upper surface of the printer body 12 is covered. A locus formed according to pivotal movement of the cover member 30 between the first position and the second position is referred to as a pivotal range.

As depicted in FIG. 2, the printer body 10 has two ink containers 20 on a side (for example, a front side, as depicted in FIG. 1) thereof at intervals. As depicted in FIGS. 2 and 3, one of the two ink containers 20 disposed on the left side of the printer body 10 includes one ink containing portion 21 for black ink, and the other of the two ink containers 20 disposed on the right side of the printer body 10 includes three ink containing portions 21 for three colors of ink, e.g., cyan, magenta, and yellow. Each of the two ink containers 20 includes a frame portion 24 and a cover portion 25. The cover portion 25 is pivotable between a closed position (FIG. 2) and a maximum opened position (FIG. 3) with respect to the frame portion 24. The frame portion 24 accommodates the ink containing portion 21 and covers the outside of the ink containing portion 21. A refill port 22 through which ink is poured into the ink containing portion 21 and a sealing member 23 configured to seal the refill port 22 are formed on a top portion of the ink containing portion 21. The cover portion 25 in the closed position covers the refill port 22, and the cover portion 25 in the maximum opened position exposes the refill port 22.

Before pouring ink, the user may first open the cover member 30 from the second position to the first position with respect to the printer body 10, then move the cover portion 25 of the ink container 20 from the closed position to the maximum opened position to expose the refill port 22, and then remove the sealing member 23 to make an access to the refill port 22. After pouring ink, the user may place the sealing member 23 onto the refill port 22, then move the cover portion 25 of the ink container 20 from the maximum opened position to the closed position, and then move the cover member 30 from the first position to the second position with respect to the printer body 10.

When the user places the sealing member 23 onto the refill port 22, the refill port 22 may not be tightly sealed by the sealing member 23. Because the cover member 30 is heavier than the cover portion 25 and the sealing member 23 is formed of flexible materials such as silicone rubber, when the sealing member 23 is subjected to external force by closing the cover portion 25 and the cover member 30, the sealing member 23 may be easily deformed or bent while the cover member 30 is tightly closed, thereby, the user may not find if the sealing member 23 rests on a proper place when just looking from the appearance of the inkjet printer 1.

SUMMARY

The present disclosure describes an inkjet printer having a cover member properly closed only when a sealing member rests on a proper place.

According to the one or more aspects of the disclosure, an inkjet printer may include a printer body, an ink container, and a cover member. The ink container may be provided in the printer body. The cover member may be pivotally connected to the printer body by a pivot shaft and pivotable between a first position, in which the cover member is opened with respect to the printer body, and a second position, in which the cover member covers the printer body. The ink container may further include an ink containing portion, a sealing member, a frame portion, and a cover portion. The ink containing portion may be configured to contain ink to be supplied to the printer body. A top portion of the ink containing portion may include a port through which ink is poured into the ink containing portion. The sealing member may be configured to seal the port. The frame portion may be configured to accommodate the ink containing portion. The cover portion may be pivotally connected to the frame portion and pivotable about a first pivot axis between a maximum opened position and a closed position with respect to the frame portion. One of a first opposing surface of the cover member and a second opposing surface of the cover portion may be provided with a protrusion, and the other of the first opposing surface and the second opposing surface may be provided with a recess portion. The first opposing surface may face the ink container. The second opposing surface may face the cover member. When the cover portion is in the closed position and the cover member is in the second position, a distance between the protrusion and the pivot shaft may be equal to a distance between the recess portion and the pivot shaft.

According to the one or more other aspects of the disclosure, an inkjet printer may include a printer body, a first cover, and a second cover. The printer body may include an ink containing portion configured to contain ink to be supplied to the printer body. A top portion of the ink containing portion may include a port communicating with an inner space of the ink containing portion. The first cover may be pivotable about a first axis within a first pivotal range between a first opened position, in which the first cover is opened with respect to the ink containing portion, and a first closed position, in which the first cover covers the ink containing portion. The first cover may include a recess at a distal end portion thereof. The second cover may be pivotable about a second axis within a second pivotal range, which is smaller than the first pivotal range, between a second opened position, in which the second cover is opened with respect to the ink containing portion, and a second closed position, in which the second cover covers the ink containing portion. The second cover may include a protrusion at a distal end portion thereof. When the first cover is in the first closed position and the second cover is in the second closed position, the protrusion of the second cover may engage with the recess of the first cover. When the first cover is in a first intermediate position, which is positioned between the first opened position and the first closed position, and the second cover is in a second intermediate position, which is positioned between the second opened position and the second closed position, the protrusion of the second cover may contact an opposing surface of the first cover and may not engage with the recess of the first cover.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

For a more complete understanding of the present disclosure, needs satisfied thereby, and the objects, features, and advantages thereof, reference now is made to the following descriptions taken in connection with the accompanying drawings. Hereinafter, illustrative embodiments of the disclosure will be described in detail with reference to the accompanying drawings. The terms "front", "back", "left", "right", "top" and "bottom" are used herein for the purpose of illustration and not of limitation. The terms "first" and "second" referenced herein are merely identification and do not have any other meaning, such as a particular order. For example, the term "first component" does not imply the presence of "second component", and the term "second component" does not imply the presence of "first component". The term "parallel" and "perpendicular" referenced herein means substantially "parallel" and "perpendicular".

The inkjet printer according to the disclosure may have various functions such as an image scanner function, a facsimile function and a copier function, in addition to a printing function. The printing function may include a double-sided image recording function capable of recording an image on both side of a recording sheet.

Figure 5:
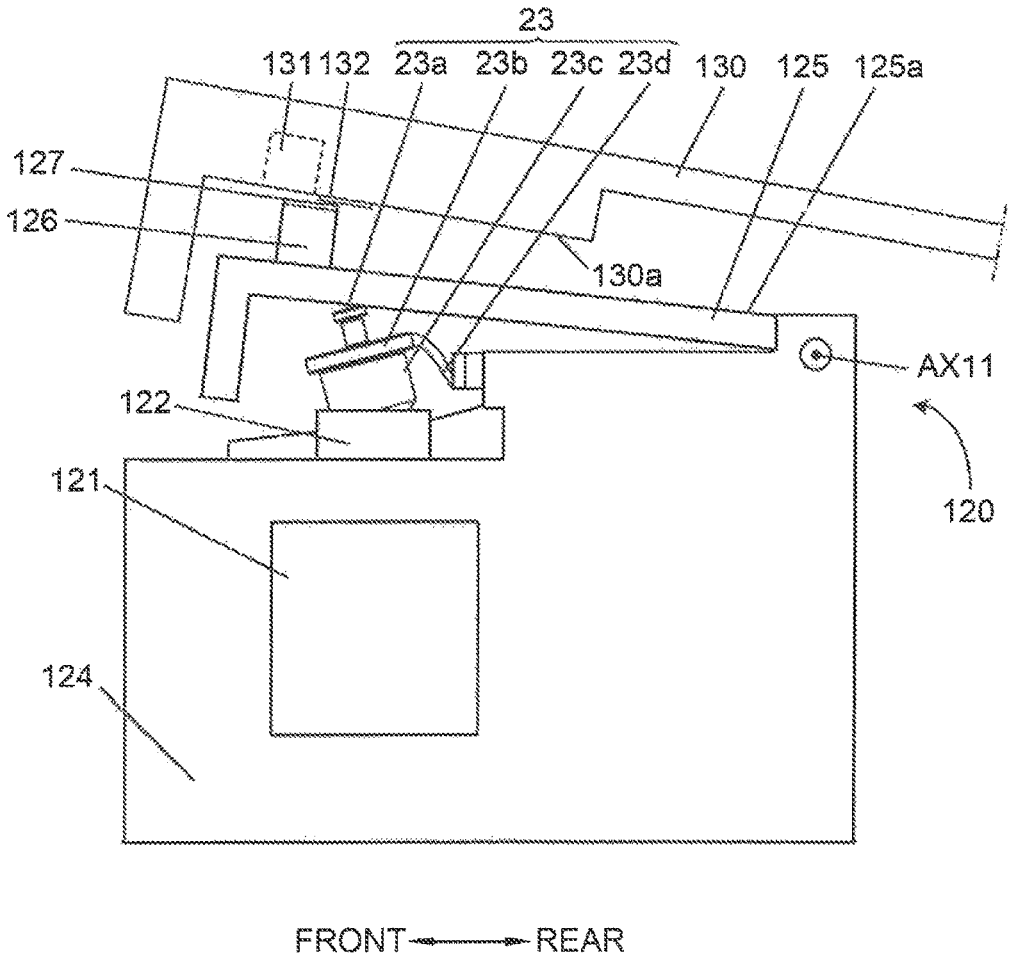
FIG. 5 is a right side view of the ink container of the inkjet printer in a first embodiment according to one or more aspects of the disclosure.

FIG. 5 depicts an ink container 120 of an inkjet printer in a first embodiment according to one or more aspects of the disclosure. The inkjet printer includes a printer body 10 including the ink container 120, and a cover member 130 pivotally connected to the printer body 10. The ink container 120 is fixed to the printer body 10. The printer body 10 has a substantially rectangular parallelepiped shape. The printer body 10 includes two ink containers 120 on the front side thereof at the interval between the left side and the right side, respectively. According to actual needs, however, the ink container 120 may be disposed at other portions of the printer body 10. Further, the ink container 120 may be also removable from the printer body 10.

First Embodiment

Figure 1:
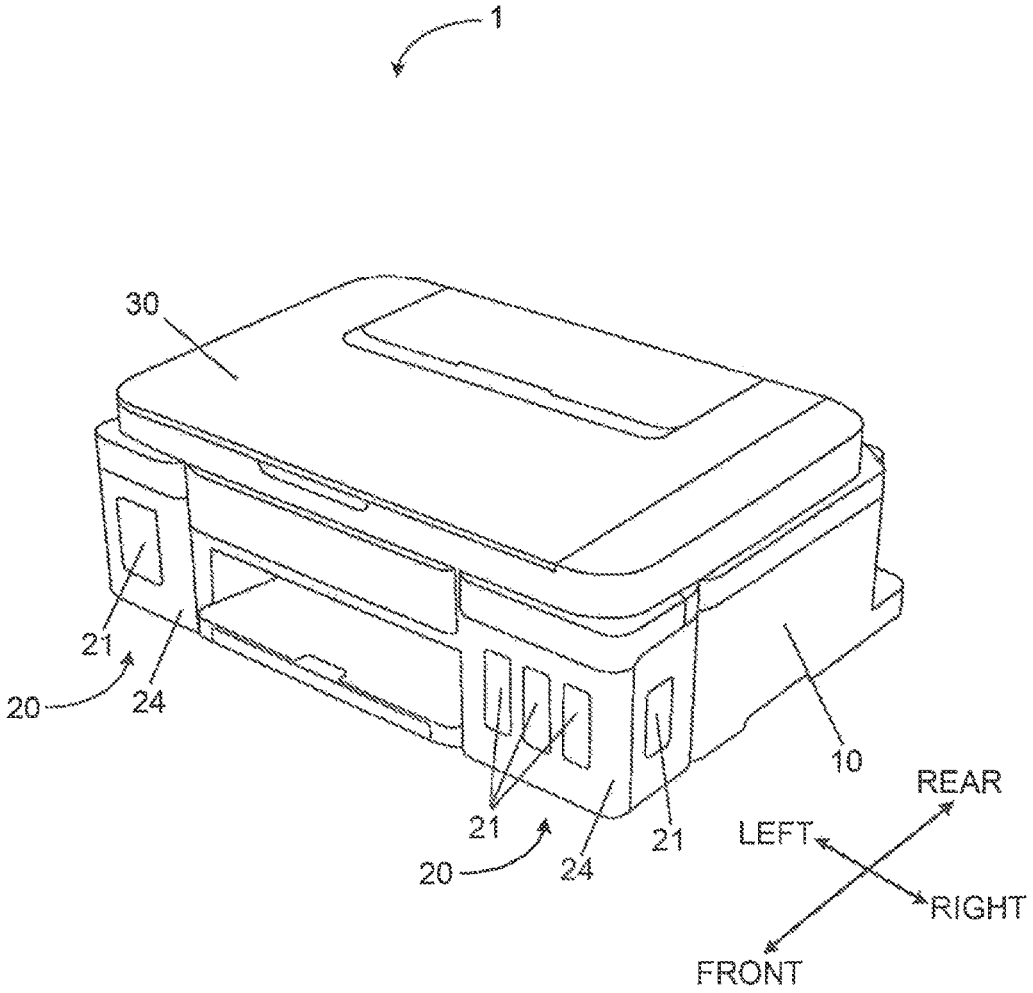
FIG. 1 is a perspective view depicting a conventional inkjet printer, in which the cover member is in the second position and the cover portion is in the closed position.
Figure 2:
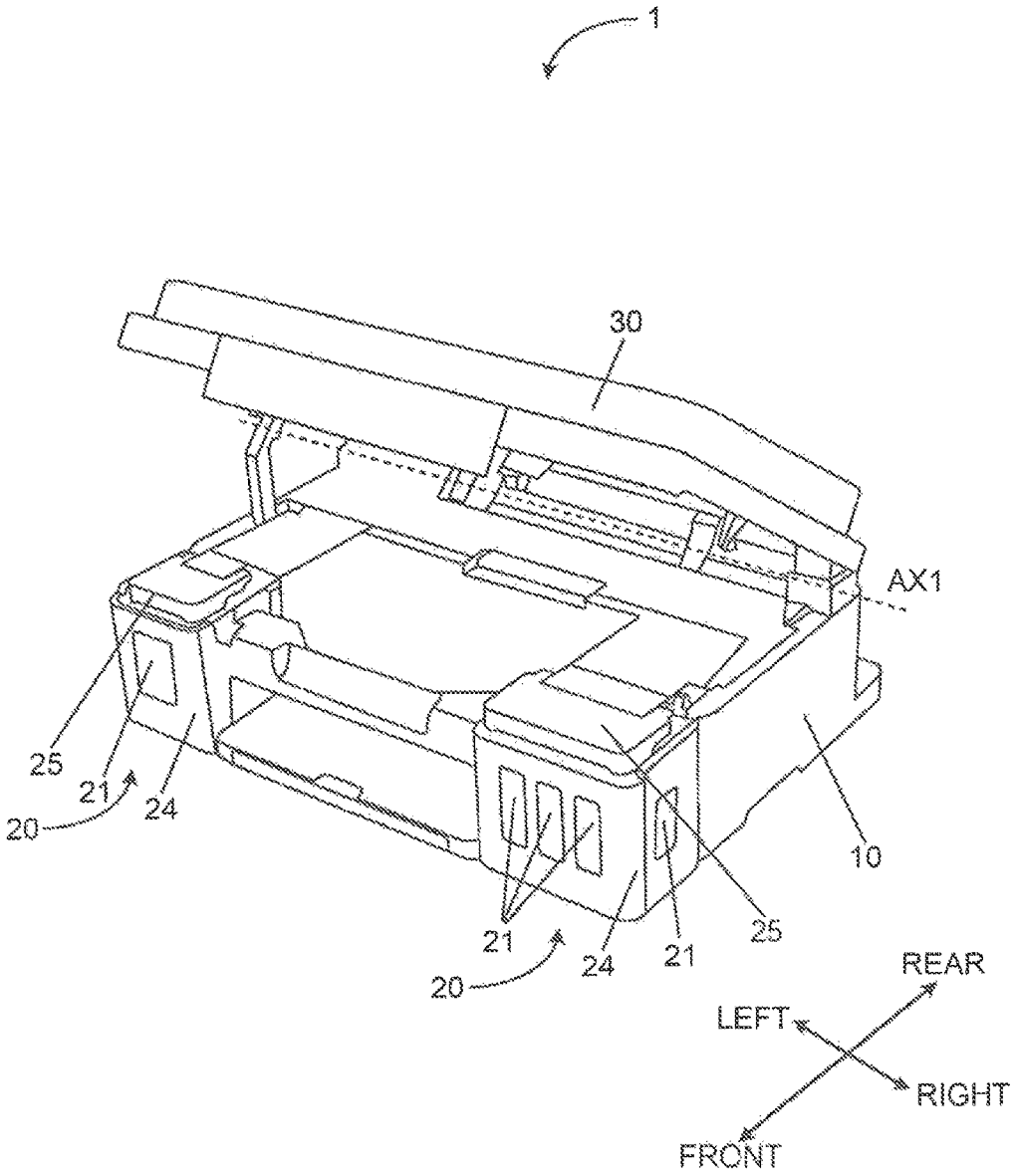
FIG. 2 is another perspective view depicting the conventional inkjet printer, in which the cover member is in the first position and the cover portion is in the closed position.
Figure 3:
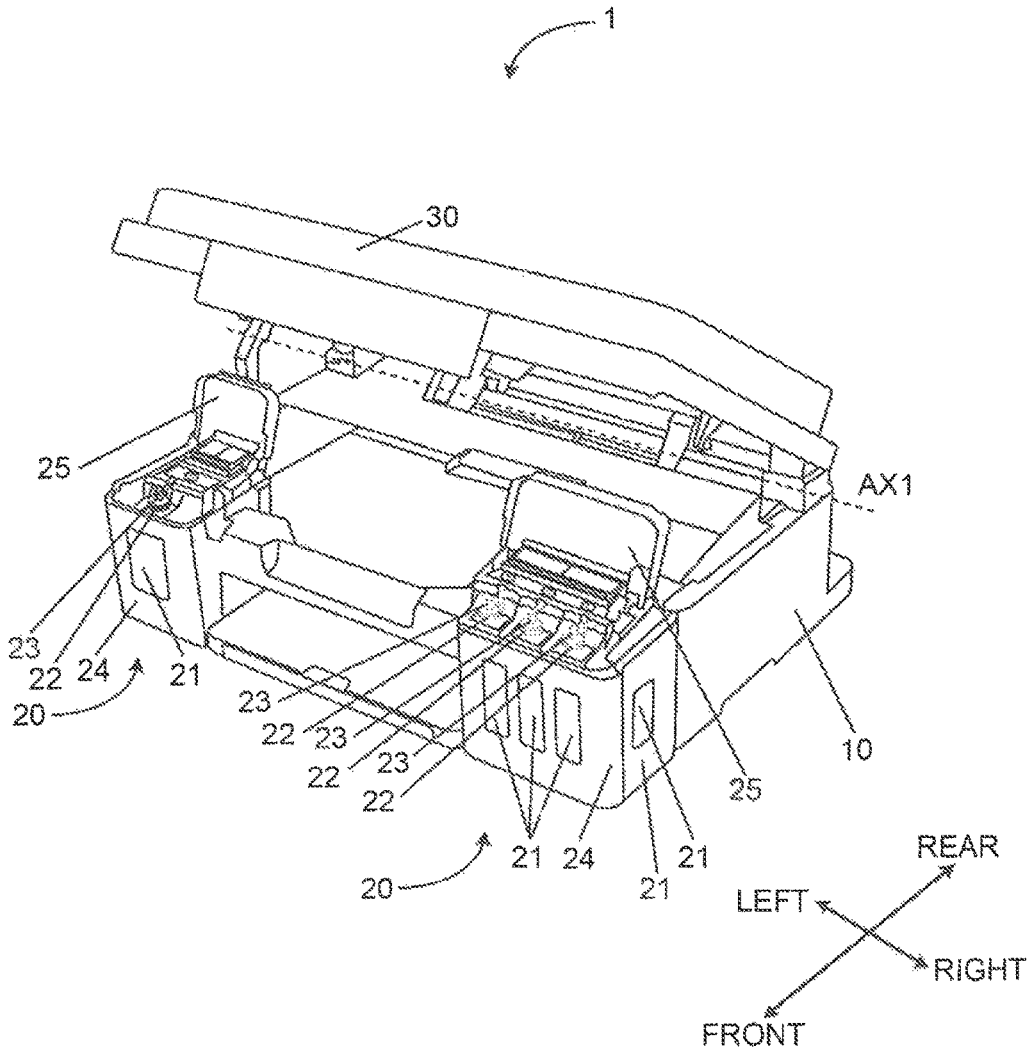
FIG. 3 is another perspective view depicting the conventional inkjet printer, in which the cover member is in the first position and the cover portion is in the maximum opened position.
Figure 4:
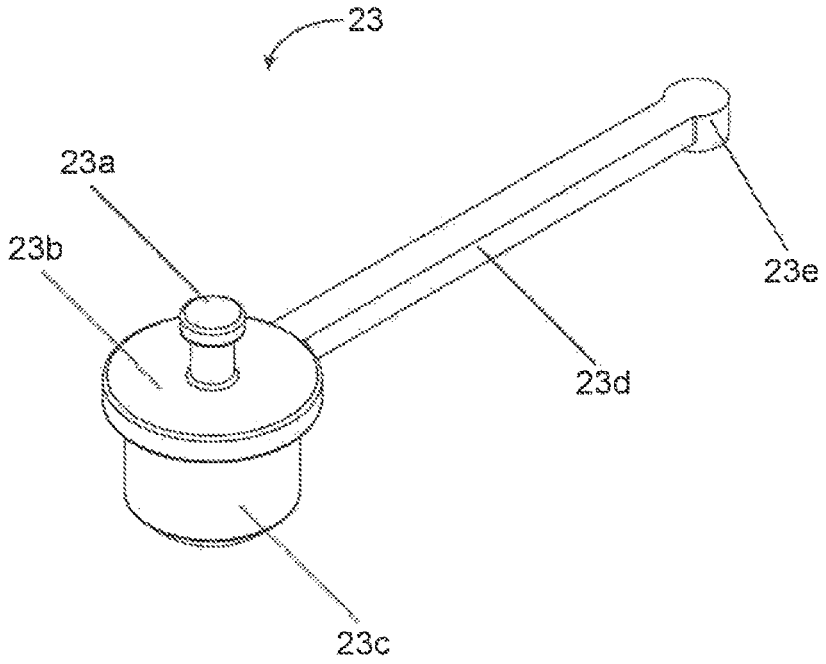
FIG. 4 is a perspective view depicting the sealing member according to one or more aspects of the disclosure.

As depicted in FIGS. 4 and 5, the ink container 120 includes three ink containing portions 121, each of which is used to contain three colors of ink, e.g., cyan, magenta, and yellow, respectively, to be supplied to the printer body 10. The number of the ink containing portions 121 may vary. The ink container 120 may include only one ink containing portion 121 storing black ink. The ink container 120 may alternatively include six, eight, or twelve ink containing portions 121, storing six, eight, or twelve colors of ink, respectively, to record the color image.

The ink container 120 further includes a frame portion 124 configured to accommodate the ink containing portion 121 and substantially surround the outer peripheral of the ink containing portion 121. Three refill ports 122 (e.g., a port) each of which is opened upward are formed on an upper surface of the frame portion 124. Each of the refill ports 122 communicates an inner space of the ink containing portion 121 to allow the user to pour ink into the ink containing portion 121 therethrough. The number of the refill ports 122 may be equal to the number of the ink containers 121. A sealing member 23 configured to seal the refill port 122 may be also provided above the refill port 122 to prevent ink from evaporating or leaking.

FIG. 4 depicts the sealing member 23 according to one or more aspects of the disclosure. The sealing member 23 includes a main body portion 23*b*, a sealing portion 23*c* positioned below the main body portion 23*b*, and a protruding portion 23*a* protruding from an upper surface of the main body portion 23*b*. The user can hold the protruding portion 23*a* with his/her fingers to operate the sealing member 23. The sealing portion 23*c* is configured to be inserted into the refill port 122. The main body portion 23*b* has a diameter greater than the diameter of the sealing portion 23*c* so as to abut against a top end of the refill port 122. Further, the sealing member 23 includes a connecting portion 23*d*. One end of the connecting portion 23*d* is connected to the main body portion 23*b*, and the other end 23*e* is configured to be connected to the frame portion 124.

Figure 6:
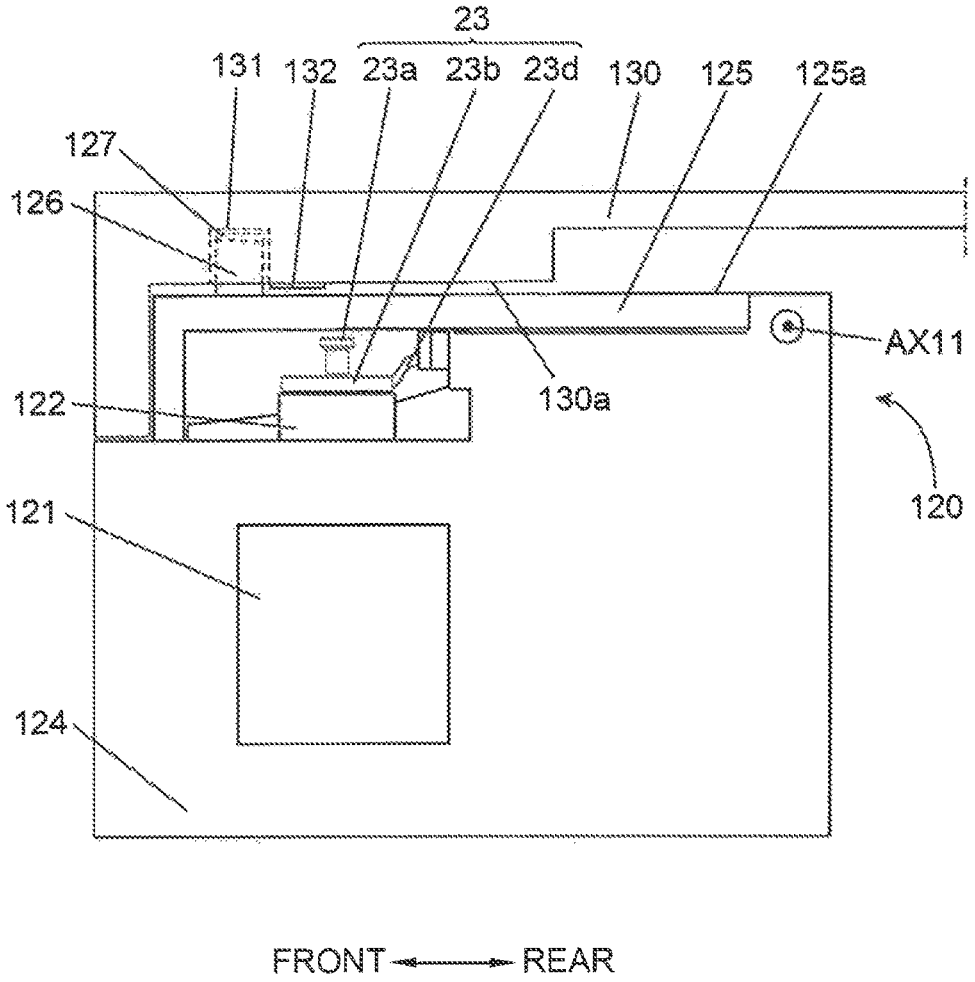
FIG. 6 is another right side view of the ink container of FIG. 5, in which the refill port is tightly sealed by the sealing member and the cover portion is in the closed position, and in which a side wall of the cover portion is omitted.

Refer to FIGS. 5 and 6, the ink container 120 further includes a cover portion 125 (e.g., a second cover). The cover portion 125 has a substantially plate shape and is pivotally connected to the frame portion 124 about a first pivot axis AX11 extending in a horizontal direction. Specifically, the cover portion 125 is pivotable between an opened position and a closed position with respect to the frame portion 124. When the cover portion 125 is in the closed position, the cover portion 125 covers the refill port 122, and when the cover portion 125 is in the maximum opened position, the refill port 122 is exposed. FIG. 6 shows a state that the cover portion 125 is in the closed position. The user may pour ink in the refill port 122 after pivoting the cover portion 125 from the closed position to the maximum opened position to expose the refill port 122.

As depicted in FIG. 6, the cover member 130 (e.g., a first cover) is provided with a recess portion 131 (e.g., a recess) on a first opposing surface 130*a* (e.g., an opposing surface) which faces the ink container 120, and the cover portion 125 is provided with a protrusion 126 on a second opposing surface 125*a* which faces the cover member 130. When the cover portion 125 is in the closed position and the cover member 130 is in the second position, the protrusion 126 may be inserted and placed into the recess portion 131.

Figure 7:
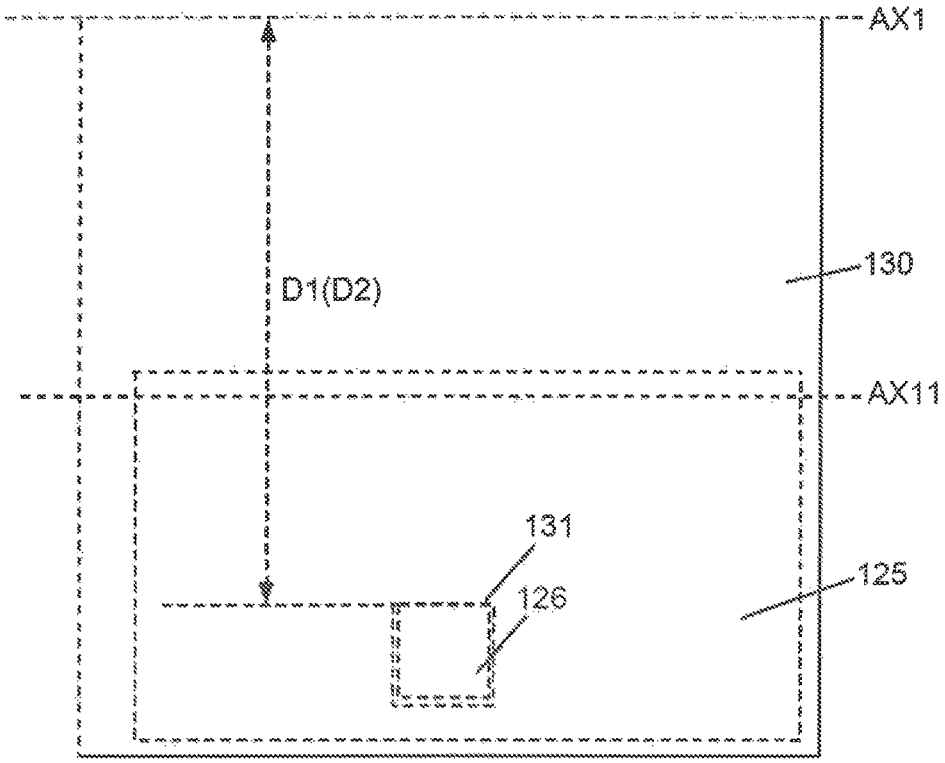
FIG. 7 is a plane view of the ink container of FIG. 5.

As depicted in FIG. 7, when the cover portion 125 is in the closed position and the cover member 130 is in the second position, a distance D1 between the protrusion 126 and a vertical plane on which the pivot shaft AX1 of the cover member 130 is positioned is equal to a distance D2 between the recess portion 131 and the vertical plane on which the pivot shaft AX1 of the cover member 130 is positioned. At this time, the protrusion 126 may be inserted and placed into the recess portion 131.

Specifically, when the sealing member 23 tightly seals the corresponding refill port 122, i.e., when the sealing portion 23*c* of the sealing member 23 is fittingly inserted into the refill port 122, the top end of the protruding portion 23*a* of the sealing member 23 is away by a predetermined distance from the refill port 122. This configuration causes the top end of the protruding portion 23*a* of the sealing member 23 to not affect the pivoting of the cover portion 125 between the maximum opened position and the closed position. In other words, this configuration allows the cover portion 125 to pivot to the closed position and also allows the top end of the protruding portion 23*a* to be spaced apart from the cover portion 125, which is at the closed position.

On the contrary, when the sealing member 23 is placed on the upper surface of the ink container 120 and the sealing member 23 does not tightly seal the corresponding refill port 122, the top end of the protruding portion 23*a* of the sealing member 23 may prevent the cover portion 125 from pivoting to the closed position. As depicted in FIG. 5, when the sealing portion 23*c* of the sealing member 23 is not inserted entirely into the refill port 122, the distance between the top end of the protruding portion 23*a* and the upper surface of the refill port 122 may be greater than the predetermined distance. This configuration causes the top end of the protruding portion 23*a* of the sealing member 23 is positioned in a pivoting path of the cover portion 125 and may affect the pivoting of the cover portion 125 between the maximum opened position and the closed position. In other words, when the user pivots the cover portion 125 from the maximum opened position to the closed position, the cover portion 125 may interfere with the sealing member 23, that is to say, the sealing member 23 may prevent the cover portion 125 from pivoting to the closed position.

When the cover portion 125 is not in the closed position, the recess portion 131 of the cover member 130 is unable to be fitted with the protrusion 126 of the cover portion 125, and the cover member 130 is also unable to pivot to the second position. Furthermore, when the sealing member 23 is placed on the upper surface of the frame portion 124 and the sealing member 23 does not tightly seal the corresponding refill port 122, the sealing member 23 may prevent the cover portion 125 from pivoting to the closed position. Thus, when the cover portion 125 is at a position other than the closed position, the protrusion 126 may abut against the first opposing surface 130*a*, thereby preventing further pivoting of the cover member 130 to the second position.

Specifically, when the sealing portion 23*c* of the sealing member 23 is not inserted entirely into the refill port 122 and the cover portion 125 is at a position other than the closed position, as depicted in FIG. 5, the sealing member 23 causes the cover portion 125 to be at an opened position (not the maximum opened position), thereby, the protrusion 126 may abut against the lower surface of the cover member 130. This configuration causes the protrusion 126 to not be inserted into the recess portion 131, and further causes the cover portion 125 to prevent pivoting of the cover member 130 to the second position.

Preferably, a first non-slip portion 127, i.e., a friction enhancement portion, may be provided at the top end portion of the protrusion 126. For example, the first non-slip portion 127 may be made of material, e.g., rubber sheet, with a larger frictional coefficient than resin. A second non-slip portion 132, which may also be made of the same or similar material, may also be provided at a contact portion, which is positioned on the first opposing surface 130*a* between the first pivot axis AX11 and the recess portion 131, in FIGS. 5 and 6. In other words, the contact portion may be positioned between the rear end of the ink container 120 and the recess portion 131.

FIG. 5 depicts that the first non-slip portion 127 is provided at the top end portion of the protrusion 126 and the second non-slip portion 132 is provided at the contact portion. However, it will be appreciated that a non-slip portion may be provided at one of the top end portion of the protrusion 126 and the contact portion. The non-slip portion would provide a greater friction between the top end portion of the protrusion 126 and the contact portion, thereby, the force from the cover member 130 may not allow the protrusion 126 to be easily slid into the recess portion 131.

Further, the protrusion 126 may also be made of flexible material, e.g., urethane rubber, such that the protrusion 126 may be deformed within a certain limit, the top end portion of the protrusion 126 may have a greater friction, and further friction enhancement portion may not be necessary on the protrusion 126.

The inkjet printer according to the present disclosure includes the printer body 10 including the ink container 120. The ink container 120 includes the sealing member 23, the frame portion 124, and the cover portion 125. One of the first opposing surface 130*a*, which faces the ink container 120, of the cover member 130 and the second opposing surface 125*a*, which faces the cover member 130, of the cover portion 125 is provided with the protrusion 126, and the other of the first opposing surface 130*a* and the second opposing surface 125*a* is provided with the recess portion 131. When the cover portion 125 is in the closed position and the cover member 130 is in the second position, the protrusion 126 may be inserted and placed into the recess portion 131. When the sealing member 23 is placed on the upper surface of the frame portion 124 and the sealing member 23 does not tightly seal the corresponding refill port 122, the sealing member 23 may prevent the cover portion 125 from pivoting to the closed position. Thus, when the cover portion 125 is at a position other than the closed position, the protrusion 126 may abut against the other of the first opposing surface 130*a* and the second opposing surface 125*a*, thereby preventing pivoting of the cover member 130 to the second position. This may clearly remind the user to place the sealing member 23 at a proper position and pivot again the cover portion 125 to the closed position, thereby preventing alteration of ink to ensure the image quality of the inkjet printer.

Second Embodiment

Figure 8:
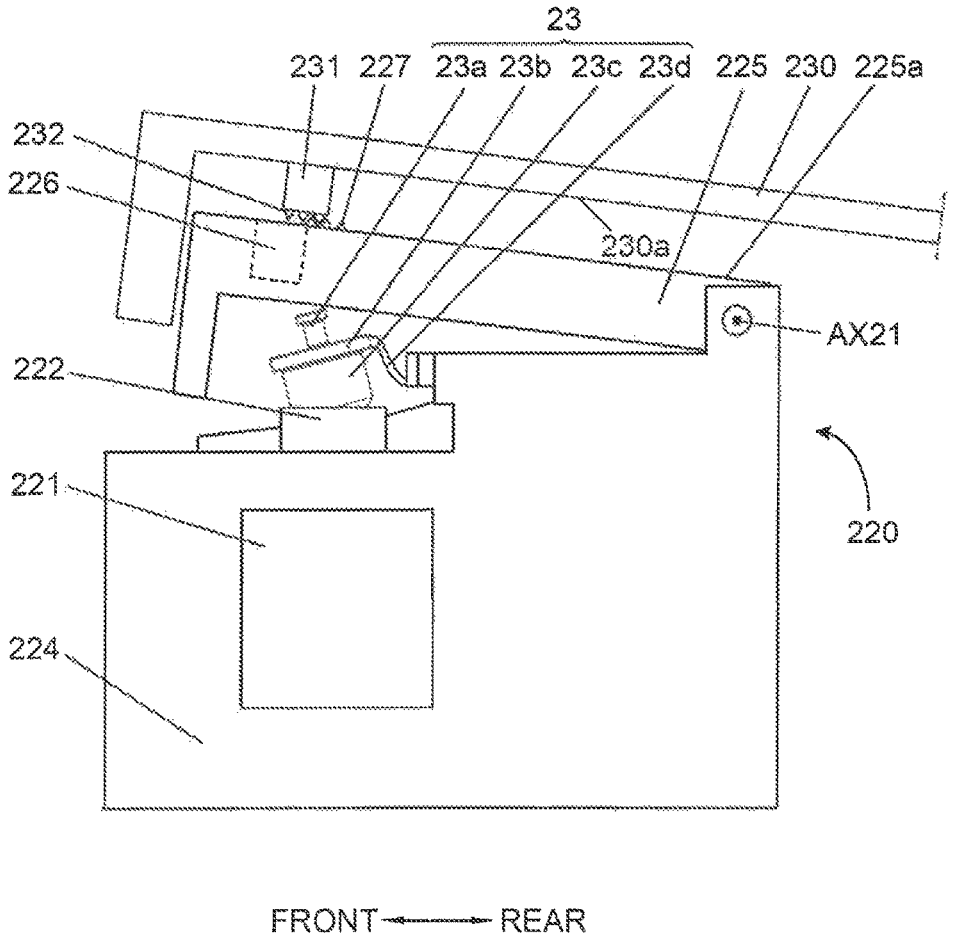
FIG. 8 is a right side view of the ink container of the inkjet printer in a second embodiment according to one or more aspects of the disclosure, in which the refill port is not tightly sealed by the sealing member and the cover portion is in a unspecified position, and in which the side wall of the cover portion is omitted.
Figure 9:
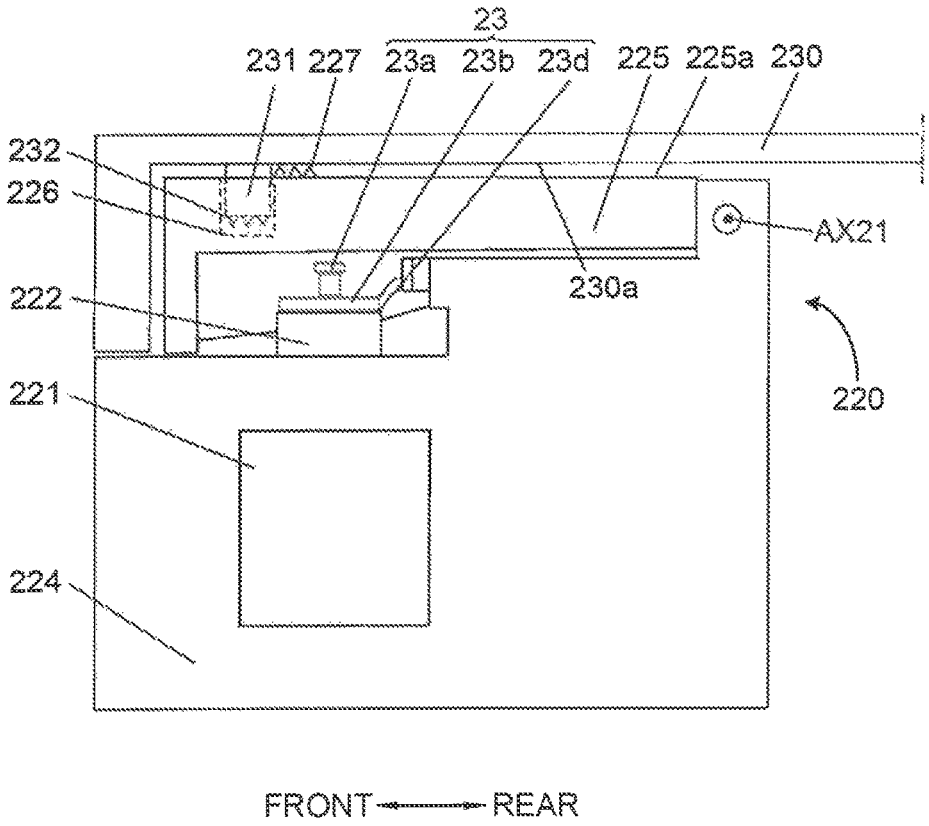
FIG. 9 is another right side view of the ink container of FIG. 8, in which the refill port is tightly sealed by the sealing member and the cover portion is in the closed position, and in which a side wall of the cover portion is omitted.

FIGS. 8 and 9 depict an ink container 220 of an inkjet printer in a second embodiment according to one or more aspects of the disclosure. Similar to the first embodiment, the ink container 220 of the second embodiment includes a frame portion 224, a cover portion 225, an ink containing portion 221, and a refill port 222.

As depicted in FIGS. 8 and 9, a cover member 230 is provided with a protrusion 231 on a first opposing surface 230*a* which faces the ink container 220, and the cover portion 225 is provided with a recess portion 226 on a second opposing surface 225*a* which faces the cover member 230. When the cover portion 225 is in the closed position and the cover member 230 is in the second position, the protrusion 231 may be inserted and placed into the recess portion 226.

Further, a distal end portion of the protrusion 231 is provided with a first engaging portion 232, and a contact portion is provided with a second engaging portion 227. The contact portion is positioned on the second opposing surface 225*a* between a first pivot axis AX21 and the recess portion 226, in FIGS. 8 and 9. In other words, the contact portion is positioned between the rear end of the ink container 220 and the recess portion 226.

Each of the first engaging portion 232 and the second engaging portion 227 may have a sawtooth surface or other engagable surface, to provide a frictional force in a direction parallel to the first opposing surface 230*a* and/or the second opposing surface 225*a*. This may prevent relative movement of the first engaging portion 232 and the second engaging portion 227 and prevent the protrusion 231 from sliding into the recess portion 232.

While the disclosure has been described in detail with reference to the specific embodiments thereof, these are merely examples, and various changes, arrangements and modifications may be applied therein without departing from the spirit and scope of the disclosure.

What is claimed is:

1. An inkjet printer comprising:

a printer body;

an ink container provided in the printer body; and a cover member pivotally connected to the printer body by a pivot shaft and pivotable between a first position, in which the cover member is opened with respect to the printer body, and a second position, in which the cover member covers the printer body, wherein the ink container further comprises:

an ink containing portion configured to contain ink to be supplied to the printer body, a top portion of the ink containing portion including a port through which ink is poured into the ink containing portion;

a sealing member configured to seal the port;

a frame portion configured to accommodate the ink containing portion; and a cover portion pivotally connected to the frame portion and pivotable about a first pivot axis between a maximum opened position and a closed position with respect to the frame portion, wherein one of a first opposing surface of the cover member and a second opposing surface of the cover portion is provided with a protrusion, and the other of the first opposing surface and the second opposing surface is provided with a recess portion, the first opposing surface facing the ink container, the second opposing surface facing the cover member, when the cover portion is in the closed position and the cover member is in the second position, a distance between the protrusion and the pivot shaft is equal to a distance between the recess portion and the pivot shaft.

2. The inkjet printer according to claim 1, wherein a non-slip portion is provided at at least one of a top end portion of the protrusion and a contact portion, the contact portion being positioned on the other of the first opposing surface and the second opposing surface between the first pivot axis and the recess portion.

3. The inkjet printer according to claim 1, wherein one of a distal end portion of the protrusion and a contact portion is provided with a first engaging portion, and the other of the distal end portion of the protrusion and the contact portion is provided with a second engaging portion, the contact portion being positioned on the other of the first opposing surface and the second opposing surface between the first pivot axis and the recess portion, the first engaging portion being engagable with the second engaging portion.

4. The inkjet printer according to claim 1, wherein the protrusion is made of flexible material.

5. The inkjet printer according to claim 1, wherein the sealing member further comprises a main body portion and a connecting portion, one end of the connecting portion being connected to the main body portion, the other end being configured to be connected to the frame portion.

6. The inkjet printer according to claim 2, wherein the non-slip portion is made of material with a larger frictional coefficient than resin.

7. The inkjet printer according to claim 1, wherein the first pivot axis of the cover portion extends parallel to the pivot shaft of the cover member.

8. The inkjet printer according to claim 1, wherein the ink container is disposed on the front side of the printer body.

9. The inkjet printer according to claim 8, wherein the ink container includes a first ink container and a second ink container at intervals.

10. The inkjet printer according to claim 9, wherein the first ink container includes a plurality of the ink containing portions.

11. The inkjet printer according to claim 10, wherein the cover portion of the first ink container is provided with a plurality of the sealing members, each of which is configured to seal the corresponding port of the ink containing portion.

12. An inkjet printer comprising:

a printer body including an ink containing portion configured to contain ink to be supplied to the printer body, a top portion of the ink containing portion including a port, the port communicating with an inner space of the ink containing portion;

a first cover pivotable about a first axis within a first pivotal range between a first opened position, in which the first cover is opened with respect to the ink containing portion, and a first closed position, in which the first cover covers the ink containing portion, the first cover including a recess at a distal end portion thereof; and a second cover pivotable about a second axis within a second pivotal range, which is smaller than the first pivotal range, between a second opened position, in which the second cover is opened with respect to the ink containing portion, and a second closed position, in which the second cover covers the ink containing portion, the second cover including a protrusion at a distal end portion thereof, wherein when the first cover is in the first closed position and the second cover is in the second closed position, the protrusion of the second cover engages with the recess of the first cover, and when the first cover is in a first intermediate position, which is positioned between the first opened position and the first closed position, and the second cover is in a second intermediate position, which is positioned between the second opened position and the second closed position, the protrusion of the second cover contacts an opposing surface of the first cover and does not engage with the recess of the first cover.

13. The inkjet printer according to claim 12, wherein the protrusion of the second cover contacts a portion of the opposing surface of the first cover, wherein the portion of the opposing surface of the first cover is closer to the first axis than the protrusion of the second cover contacts.

14. The inkjet printer according to claim 12, further comprising a sealing member configured to seal the port.

15. The inkjet printer according to claim 14, wherein the sealing member is provided on the second cover.

* * * * *